US006679154B1

(12) United States Patent
Paul

(10) Patent No.: US 6,679,154 B1
(45) Date of Patent: Jan. 20, 2004

(54) PASSIVE DYNAMICALLY DISCONNECTING ARM

(75) Inventor: Buddy R. Paul, Perry Hall, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/302,960

(22) Filed: Nov. 25, 2002

(51) Int. Cl.[7] ..... F41F 3/04

(52) U.S. Cl. ..... 89/1.806; 89/1.807; 89/1.811; 244/137.4

(58) Field of Search ..... 89/1.8, 1.806, 89/1.807, 1.811, 1.812, 1.815; 244/137.4

(56) References Cited

U.S. PATENT DOCUMENTS

| | | | | | |
|---|---|---|---|---|---|
| 3,518,613 | A | | 6/1970 | Alpert | 339/45 |
| 3,724,322 | A | | 4/1973 | Reed | 89/1.811 |
| 3,780,617 | A | | 12/1973 | Tabari et al. | 89/1.811 |
| 3,883,209 | A | | 5/1975 | Kongelbeck | 89/1.811 |
| 4,037,821 | A | | 7/1977 | Greene | 254/93 R |
| 4,138,181 | A | | 2/1979 | Hacker et al. | 339/45 R |
| 4,388,853 | A | | 6/1983 | Griffin et al. | 89/1.5 F |
| 4,572,053 | A | * | 2/1986 | Sosnowski et al. | 89/1.51 |
| 4,611,944 | A | * | 9/1986 | Larson | 403/60 |
| 4,711,151 | A | | 12/1987 | Griffin et al. | 89/1.805 |
| 5,652,404 | A | | 7/1997 | Girard | 89/1.811 |
| 5,710,388 | A | | 1/1998 | Hutchinson et al. | 89/1.811 |
| 5,714,708 | A | | 2/1998 | Shim et al. | 89/1.806 |
| 5,744,745 | A | * | 4/1998 | Shim et al. | 89/1.806 |
| 5,755,407 | A | * | 5/1998 | Aubret et al. | 244/161 |
| 6,286,409 | B1 | * | 9/2001 | Na et al. | 89/1.806 |

* cited by examiner

*Primary Examiner*—J. Woodrow Eldred
(74) *Attorney, Agent, or Firm*—Mark A. Wurm

(57) ABSTRACT

The passive dynamically disconnecting arm features an arm having two ends wherein attached to the first end is a housing having both a plunger and an electrical connector providing positive engagement force during shock or vibration. The second end of the arm features a trunnion and torsion spring. The arm features a slot wherein a rod is placed inside operatively coupled to both the plunger and trunnion. When an object is attached to the electrical connector, the spring-loaded plunger compresses preventing the rod from moving and causing the second end of the rod to couple with a divot within the trunnion. When the object moves a predetermined distance, the spring-loaded plunger decouples from the rod and the electrical connector detaches from the object. The arm, by means of a torsion spring attached to the arm's second end, translates and rotates out of the object's path without striking the object.

17 Claims, 7 Drawing Sheets

PASSIVE DYNAMICALLY DISCONNECTING ARM

This invention was made with Government support under Contract No. DASG60-00-C-0072 awarded by the Missile Defense Agency. The Government has certain rights in this invention.

FIELD OF INVENTION

The present invention relates to a connector and, more particularly, to an improved electrical umbilical connector for a missile.

BACKGROUND OF THE INVENTION

An electrical umbilical cord typically connects the weapon such as a missile to the control system of surface vehicle or air craft such as, naval vessels, planes, helicopters, or tanks. Through this connection, information is transmitted to and from both the weapon and the vehicle.

Typically, this electrical umbilical cord is a flexible multi-connector electrical cable, which detaches from the weapon after the weapon travels a predetermined distance. In other embodiments, the cord is cut when the weapon is fired. Once his cord is cut or detaches from the weapon, the cord cannot be controlled and in some circumstances, can damage the weapon. Additionally, since surface craft and aircraft often operate under adverse and extreme conditions, the weapon can shift causing the electrical connector to detach from the weapon rendering it inoperable.

There are several examples of prior art electrical umbilical cords known within the art. For example, U.S. Pat. No. 5,710,938 to Hutchinson et al. discloses an umbilical cord connecting the control systems of a vessel to the system of a projectile that is housed within a canister. The prior art umbilical cable features a cable having a plurality of conductors and an insulating layer over the conductors. Once the projectile is launched, the conductors are pulled away from the insulation, allowing the projectile to travel.

U.S. Pat. No. 3,724,322 to Reed teaches an electrical umbilical cord that attaches a control system of the projectile to the control system of the vessel. When the projectile is launched, the spring loaded plunger draws the umbilical cable upward and away from the projectile.

U.S. Pat. No. 3,516,613 to Alpert teaches a mechanical linkage connected to both the projectile and the vessel. When the projectile is launched, the mechanical linkage eliminates any shearing action on the connector pins allowing the connector to cleanly separate from the projectile.

U.S. Pat. No. 4,388,853 to Griffin et al. teaches a mechanical projectile launching system on an aircraft. The mechanical system that releases the missile suspension hooks also withdraws the umbilical plug from the projectile.

The problem in the prior art is that no connector provides positive engagement with minimum radial force to a missile or the like during shock and vibration loads enabling the connector to shift without decoupling.

SUMMARY OF THE INVENTION

The present invention features an elongated arm having a first end and a second end. A trunnion featuring an elongated member is attached to the first end of the arm. Attached to the second end of the arm is a spring loaded plunger. Between the first and second end of the arm is a slot where a rod is placed. This rod is operatively coupled to both the plunger and trunnion. A connector on a floating platform is also attached to the second end of the arm allowing the connector to be operatively coupled to an object, such as a missile. When the connector is operatively coupled to the object, the spring loaded plunger is substantially in contact with the object. A torsion spring attached to the first end of the arm creates a force around the first end of the arm, rotating the arm when the rod is not substantially touching the plunger.

In another embodiment, the present invention features an elongated arm having a first end and a second end where a slot is formed. Attached to the first end of the arm is a trunnion having a torsion spring and an elongated member with a divot. Attached to the second end of the arm is a plunger having an elongated member within the slot. A rod is placed within the slot of the arm and is substantially in contact with the plunger and coupled to the divot on the elongated member of the trunnion. Attached to the second end of the arm is a connector on a floating platform. The torsion spring causes the arm to rotate when the rod is not in contact with the plunger.

In yet another embodiment, the present invention features an elongated arm having a first end and a second end where a slot is formed. Attached to the first end of the elongated arm is a torsion spring. Additionally, a trunnion having an elongated member containing a divot is attached to the first end of the arm. Attached to the second end of the elongated arm is a plunger with an elongated member extending within the arm. A rod, within the slot, is operatively coupled to the divot on the elongated member of the trunnion and is substantially in contact with the plunger. The torsion spring causes the arm to rotate when the plunger is no longer in contact with the rod. Additionally, a connector having a floating platform is attached to the second end of the arm and the connector is operatively coupled to an object.

BRIEF DESCRIPTION OF THE DRAWINGS

The above and other advantages and features of the present invention will be better understood from the following detailed description of the preferred embodiments of the invention, which is provided in connection with the accompanying drawings. The various features of the drawings may not be to scale. Included in the drawing are the following figures.

DETAILED DESCRIPTION

Figure 1:
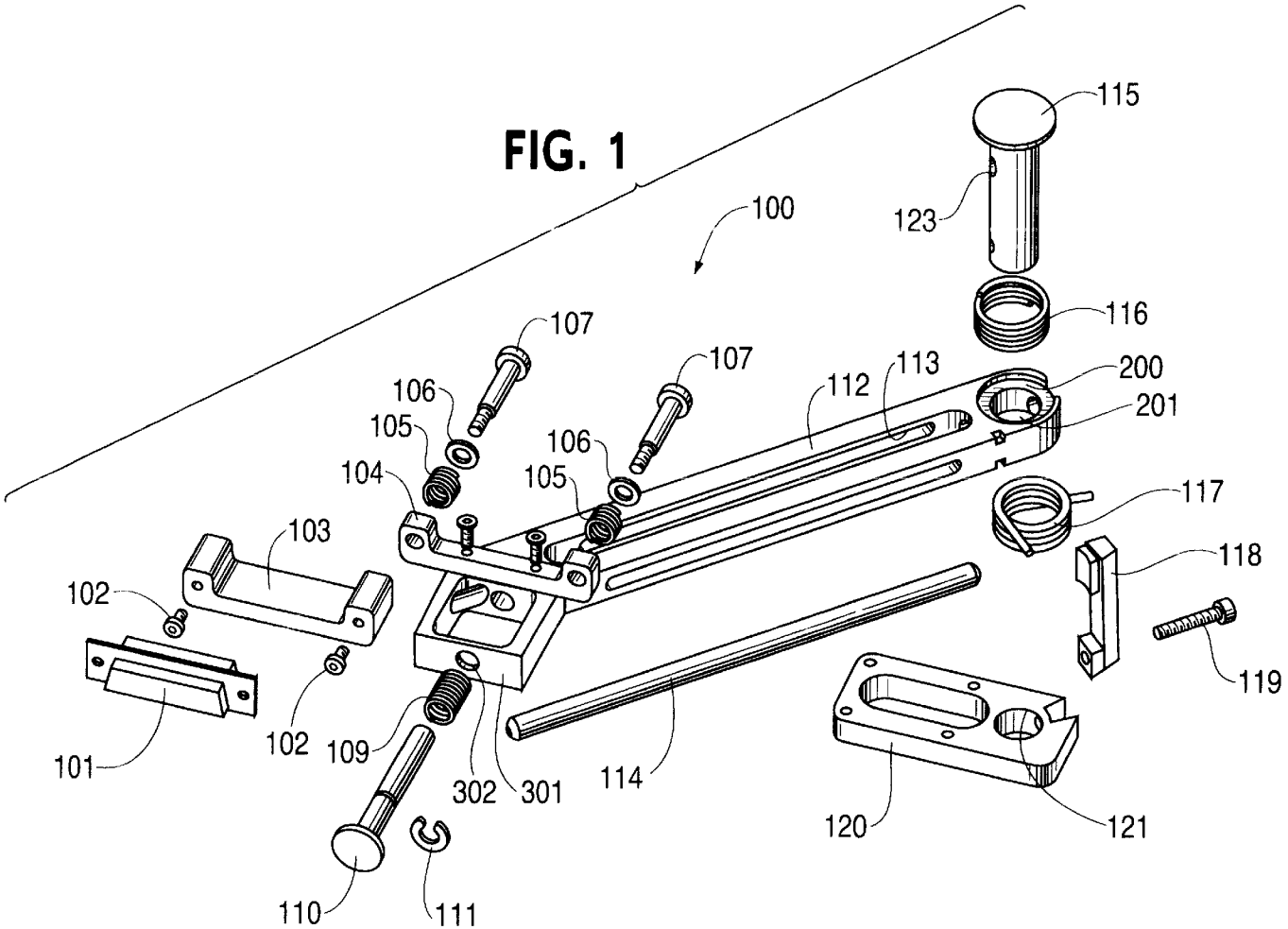
FIG. 1 is an exploded view of the passive dynamically disconnecting arm.

FIG. 1 details an exploded view of the passive dynamically disconnecting arm 100 having connector 101 attached to housing 103 by at least one screw 102, or the like. It is to be understood that connector 101 is a connector well known in the art for conducting electrical signals and the connector 101 couples the object to the control system of various surface or aircraft. In other embodiments, both the connector 101 and housing 103 can be of one-piece, unitary construction.

Housing 103 attaches to shoulder housing 104 utilizing at least one shoulder screw 107, at least one pressure spring 105 and at least one washer 106. The pressure spring 105 and shoulder screw 107 provides the force allowing connector 101 to couple with the object while limiting the travel of the housing and the shoulder screw 107 enables the pressure spring 105 to be in the proper position. In this configuration, a floating platform for the connector 101 is created by the attachment of the connector 101 to the housing 103, pressure spring 105 and shoulder screw 107. This floating platform provides positive, passive engagement and minimum radial force enabling the connector 101 by means of its attachment to shoulder housing 104 to shift without decoupling the connector 101 to the object. While the passive dynamically disconnecting arm 100 is described as utilizing pressure spring 105, washer 106 and shoulder screw 107 to create a floating platform for connector 101, any means known in the art can be utilized to create the floating platform for connector 101.

Arm 112, preferably, has two ends wherein the first end 200 features hole 201 and the second end 300 features shoulder mounting bracket 301. Between the first end 200 and second end 300 of arm 112 is slot 113, wherein rod 114 is placed within the slot 113 and inserted into holes (not shown in FIG. 1) within the walls of the first end 200 and the second end 300, which is described below.

Post 118 attaches to base plate 120 by means of a screw 119 or the like and is inserted into groove 205 of the second end 200 of arm 112. Post 118 prevents the rotation of arm 112 until translation occurs and provides a striker for torsion spring 117. Base plate 120 also features a hole 121 to support the shaft of the trunnion 115. It is to be understood that the base plate 120 can be directly or indirectly attached to the item that is carrying the object. For example, this item could be a weapon canister or, in other embodiments, the item can be any surface craft or aircraft well known within the art.

Shoulder housing 104 attaches to shoulder mounting bracket 301 by means well known within the art such as screws or the like. In alternative embodiments, the shoulder housing 104 can also be permanently attached to shoulder mounting bracket 301 or shoulder housing 104 and shoulder mounting bracket 301 can be of unitary construction.

Figure 2:
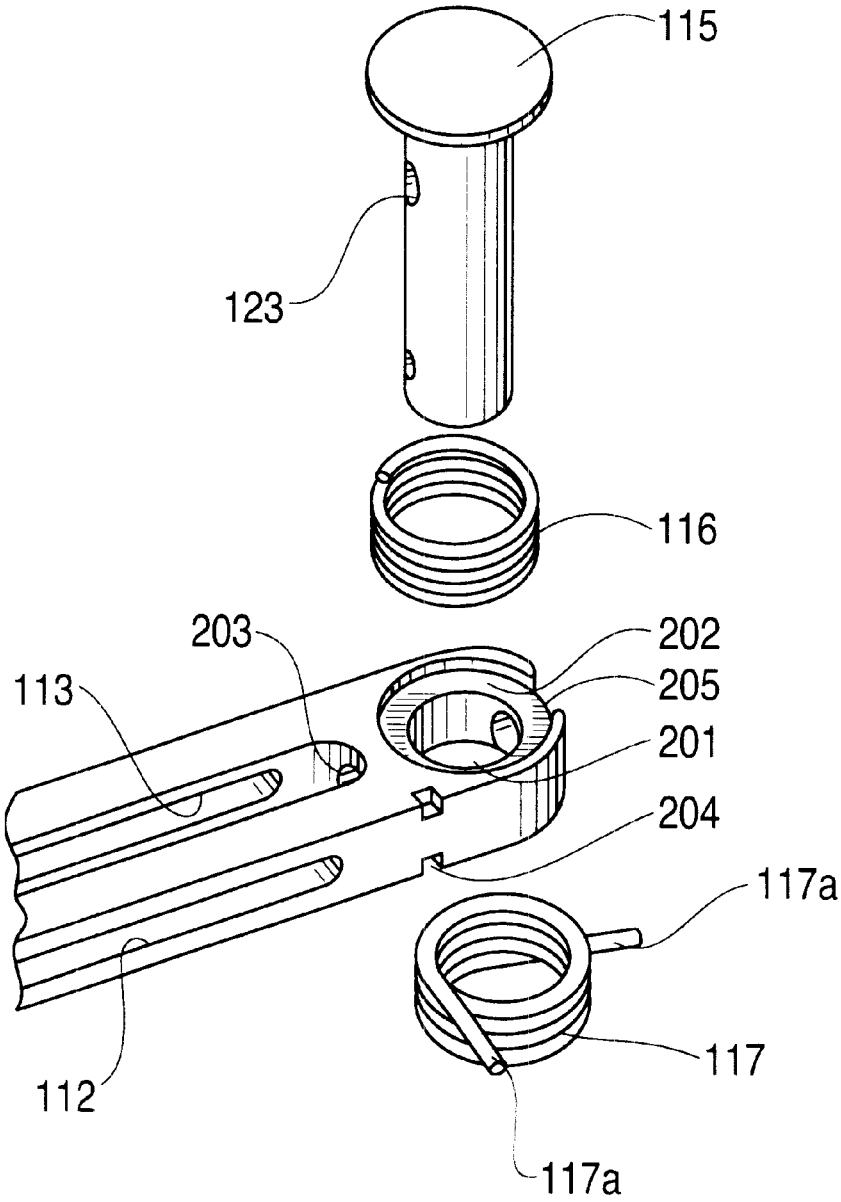
FIG. 2 is a detailed view of the first end of the passive dynamically disconnecting arm.

FIG. 2 is a detailed view of the first end 200 of arm 112. While the first end 200 of arm 112 is shown as being substantially rounded, it would not depart from the spirit of the present invention to have other shapes or geometries.

The first end 200 of arm 112 features hole 201 allowing trunnion 115 to be placed within. The top surface of the first end 200 also features a recessed groove 202 allowing the compression spring 116 to be placed within and the recessed groove 202 prevents the compression spring 116 from shifting. The compression spring 116 forces the arm 112 to translate along the trunnion 115. It should be appreciated that the diameter of the compression spring 116 is substantially the same diameter of the recessed groove 202. The bottom surface of the first end 200 of the arm 112 also features at least one notch 204, allowing the at least one end 117*a* of torsion spring 117 to be connected to the bottom of the first end 200 of arm 112. The second end of torsion spring 117 rests against post 118 wherein this combination allows torsion spring 117 to be compressed and allows the torsion spring 117 to rotate the arm 112 when an event occurs. A substantially vertical groove 205 is within the outer surface of the second end 200 allowing post 118 to rest within.

Trunnion 115 is an elongated member having two ends wherein between its two ends is an indentation or divot 123. Trunnion 115 is the pivot point for arm 112 and retains both the compression spring 116 and torsion spring 117. Once compression spring 116 is placed within the recessed groove 202, trunnion 115 is inserted through both the compression spring 116 and hole 201. When the torsion spring 117 decompresses, the compression spring 116 forces the arm 112 to translate along the trunnion 115. The first end 200 also features hole 203 cut radially into the first end 200 allowing rod 114 to be inserted within, which is described below.

Rod 114 is an elongated member having two ends. After rod 114 is placed within the slot 113 of the arm 112, the rod 114 is inserted into the hole 203 of the first end 100 of the arm 112 and presses against the divot 123 in the shaft of the trunnion 115. The end of rod 114 within the divot 123, creates a frictional attachment, thereby preventing the arm 112 from rotating due to the force exerted on arm 112 by torsion spring 117, which is attached to both the arm 112 and post 118. While both rod 114 and trunnion 115 are described as being frictionally attached to each other by means of divot 123, other variations can exist without departing from the spirit of the present invention as long as both trunnion 115 and rod 114 are releasably attached to each other.

Figure 3:
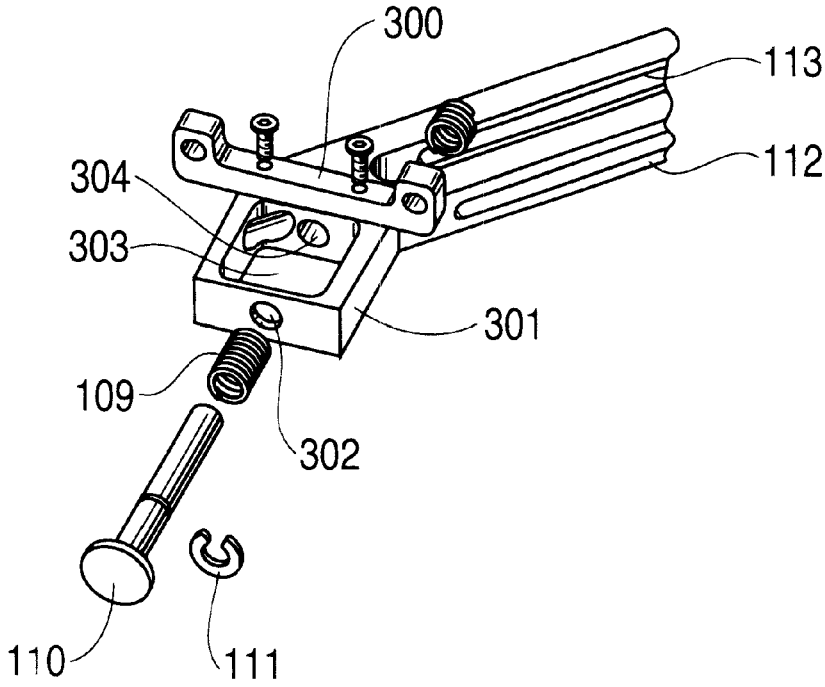
FIG. 3 is a detailed view of the second end of the passive dynamically disconnecting arm.

FIG. 3 is a detailed view of the second end 300 of arm 113 having the shoulder mounting bracket 301 wherein the shoulder mounting bracket has a first hole 302, second hole 304 and gap 303. While the shoulder-mounting bracket 301 is shown as being substantially rectangular in shape, other shapes or geometries can exist without departing from the spirit of the present invention. Shoulder mounting bracket 301 can be attached to arm 112 by means well known in the art or, in other embodiments, arm 112 and shoulder-mounting bracket 301 can be of unitary construction. As shown in FIGS. 1 and 3, shoulder-mounting bracket 301 is at an angle (preferably an acute angle) to arm 112. In other embodiments, there could be any angle or no angle between arm 112 and shoulder mounting bracket 301.

Spring 109 is placed within gap 303 and plunger 110 is inserted through hole 302, spring 109 and hole 304 of shoulder mounting bracket 301. Clamp 111 or the like attaches to plunger 110 near the end of spring 109 and the spring 109 is not compressed against the shoulder mounting bracket 301. When pressure is exerted against the end of plunger 110, spring 109 compresses against the end of the shoulder mounting bracket 301 and clamp 111 due to the force exerted on the end of plunger 110.

Figure 4:
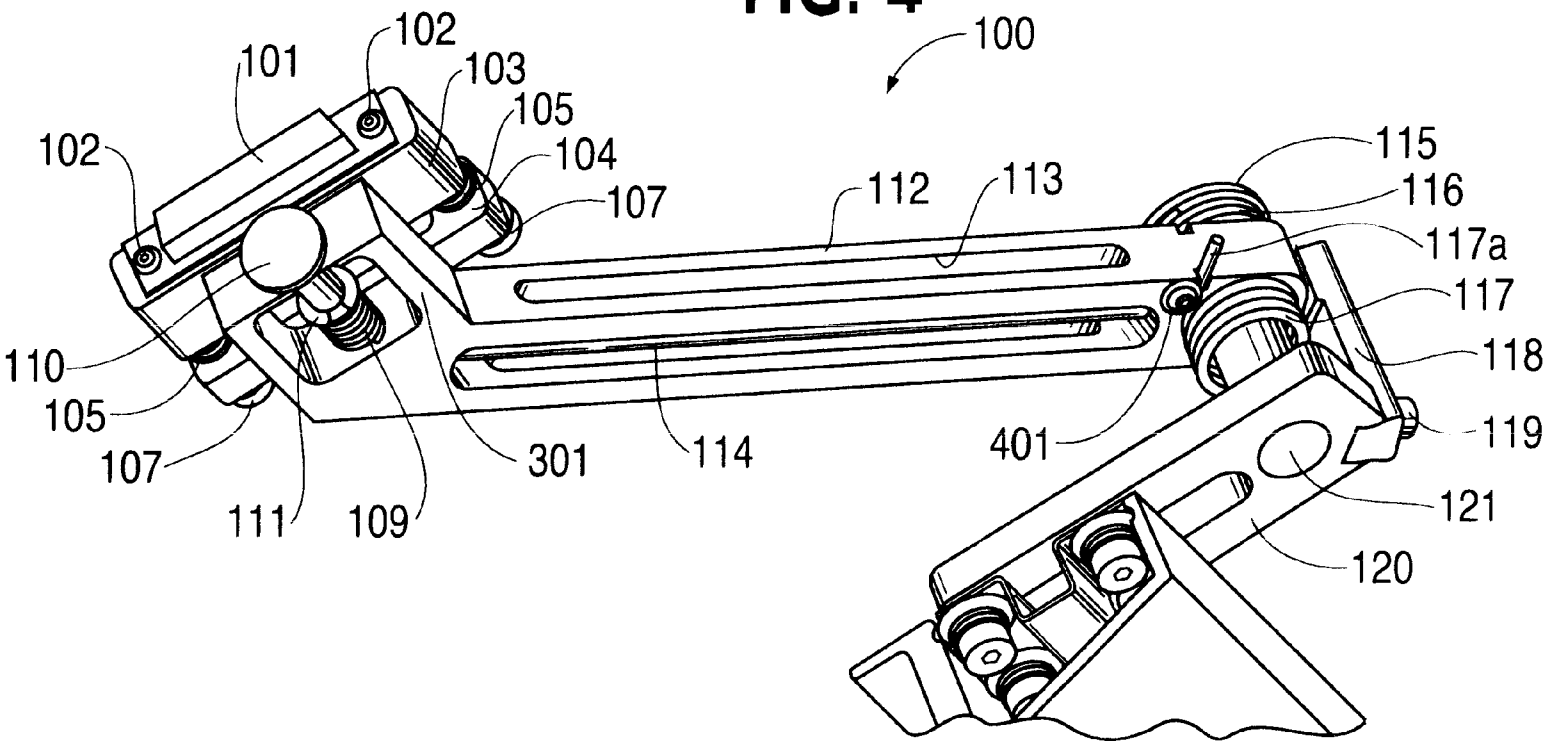
FIG. 4 is a perspective view of the passive dynamically disconnecting arm.

FIG. 4 illustrates the passive dynamically disconnecting arm 100 in the preferred embodiment. As shown in FIG. 4, plunger 110 is inserted into hole 302, 304 and spring 109 and the clamp 111 is attached to the shaft of plunger 110 above spring 109. While not shown in FIG. 4, it is to be understood that the shaft of plunger 109 is substantially in contact with the end of rod 114 within the second end 300 of the arm 112.

The first end 200 of the arm 112 has fastener 401 ensuring that the end 117*a* of the torsion spring 117 is securely fastened. While not shown in FIG. 4, the second end of torsion spring is in contact with post 118, as described above. In this configuration, it is to be understood, that torsion spring 117 is compressed and is creating a force around the first end of arm 112. As described above, trunnion 115 is inserted through compression spring 116, hole 201, torsion spring 117 and hole 121 of base plate 120. While not shown in FIG. 4, it is to be understood that the end of rod 114 is inserted within the divot 123 of trunnion 115.

When the shaft of plunger 109 is substantially in contact with the end of rod 114 within the second end 300 of arm 112 and the other end of rod 114 is inserted into the divot 123 of the trunnion 115, the arm 112 cannot substantially move, even though compression spring 116 and torsion spring 117 create a force around the hole 201 of the first end 200 of the arm 114. Instead, the passive dynamically disconnecting arm 100 provides positive engagement to the object even during shock and vibration loads since the shaft of plunger 110 does not release arm 114.

Figure 5A:
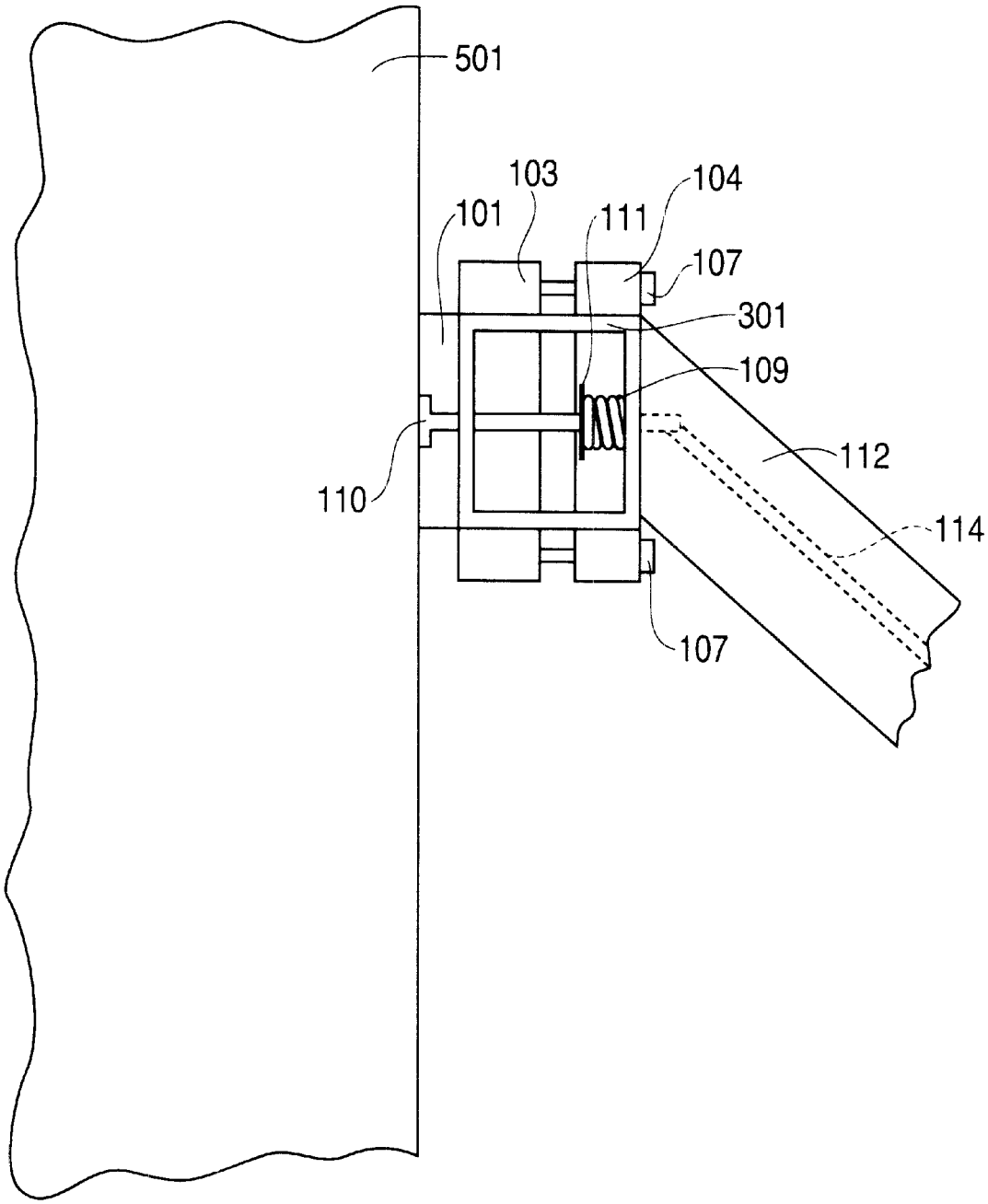
FIG. 5*a* is a view of the passive dynamically disconnecting arm attached to an object.

FIG. 5*a* details the passive dynamically disconnecting arm connected to an object 501. Object 501 can be any object or projectile well known within the art such as, but not limited to, a weapon, missile, or drop tank. When the passive dynamically disconnecting arm 100 is attached to the object 501, the connector 101 conductors electrical signals, or the like, to or from the object 101 and the control systems of the surface or aircraft which the passive dynamically disconnecting arm is attached.

As described above and shown in FIG. 5*a*, the second end of arm 112 and shoulder housing 104 are attached to the shoulder mounting bracket 301 whereby the housing 103 attaches to shoulder housing 104 utilizing shoulder screw 107, pressure spring 105 and washer 106. The connector 101 is attached to housing 103 thereby a floating platform is created for the connector, as described above. The second end of arm 112 features shoulder mounting bracket 301 where plunger 110 is operatively coupled thereto. The object 501 couples to the connector 101 and forces the spring 109 of the plunger 110 to compress thereby causing the elongated member of the plunger 110 to be in contact with rod 113.

In this position, if the object 501 moves, the connector 101 remains substantially operatively coupled to object 501 due to the floating platform created by the pressure spring 105 within shoulder housing 104 and housing 103. This floating platform provides positive, passive engagement and minimum radial force enabling the connector 101 by means of its attachment to shoulder housing 104 to shift without decoupling the connector 101 from the object 501. Therefore, the connector 101 moves in the direction of the object 501 without prematurely decoupling from the object 501.

Plunger 110 is an elongated member having two ends wherein the first end is in contact with object 501 and the second end of plunger 110 is elongated and is within arm 112. Within arm 112 is rod 113 having two ends wherein in FIG. 5*a*, the first end of rod 113 is shown in contact with the second end of plunger 110 inside arm 112.

Figure 5B:
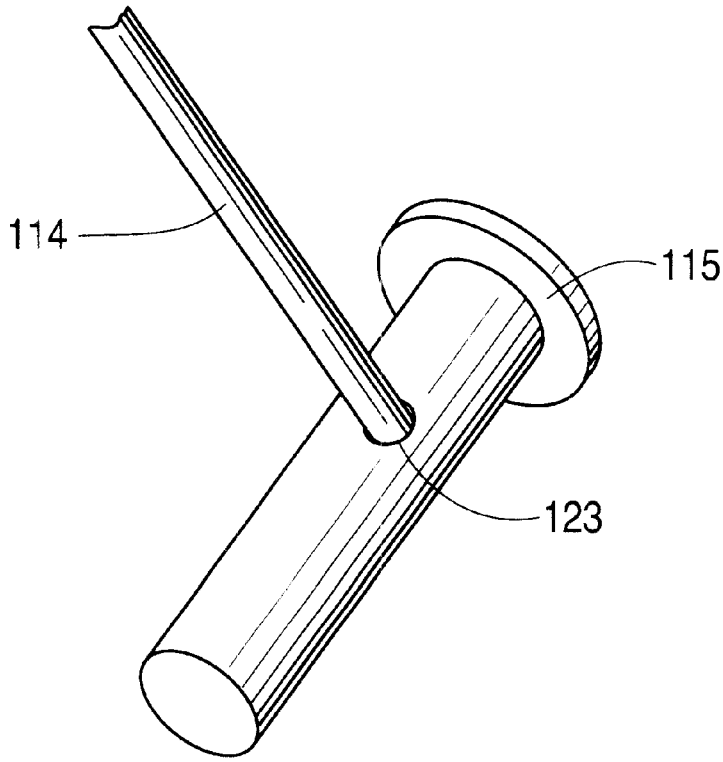
FIG. 5*b* is a view of the first end of the passive dynamically disconnecting arm.

FIG. 5*b* shows in greater detail the trunnion 115 having divot 123 within its elongated member. While FIG. 5*b* does not show the other elements of the arm 112, it is to be understood that the elements are present. As described above, the rod 114 is within the slot 113 of the arm 112 and since the second end of the rod 114 is braced against the plunger 110, as described above, the first end of rod 114 is within the divot 123 of the trunnion 115 thereby causing the first end of the rod 114 to be frictionally attached to trunnion 115. While not shown in FIG. 5*b*, this frictional attachment prevents the arm 112 from rotating due to the force exerted around the hole 200 of the arm 112 by the torsion spring 117.

It should be appreciated that the elements described in FIGS. 5*a* and 5*b* allow small movements such as vibrations or the like of object 501 without causing the connector 101 to decouple from the object 501 or causing the torsion spring 117 to cause the arm 112 to rotate and translate away from the object 501.

Figure 6:
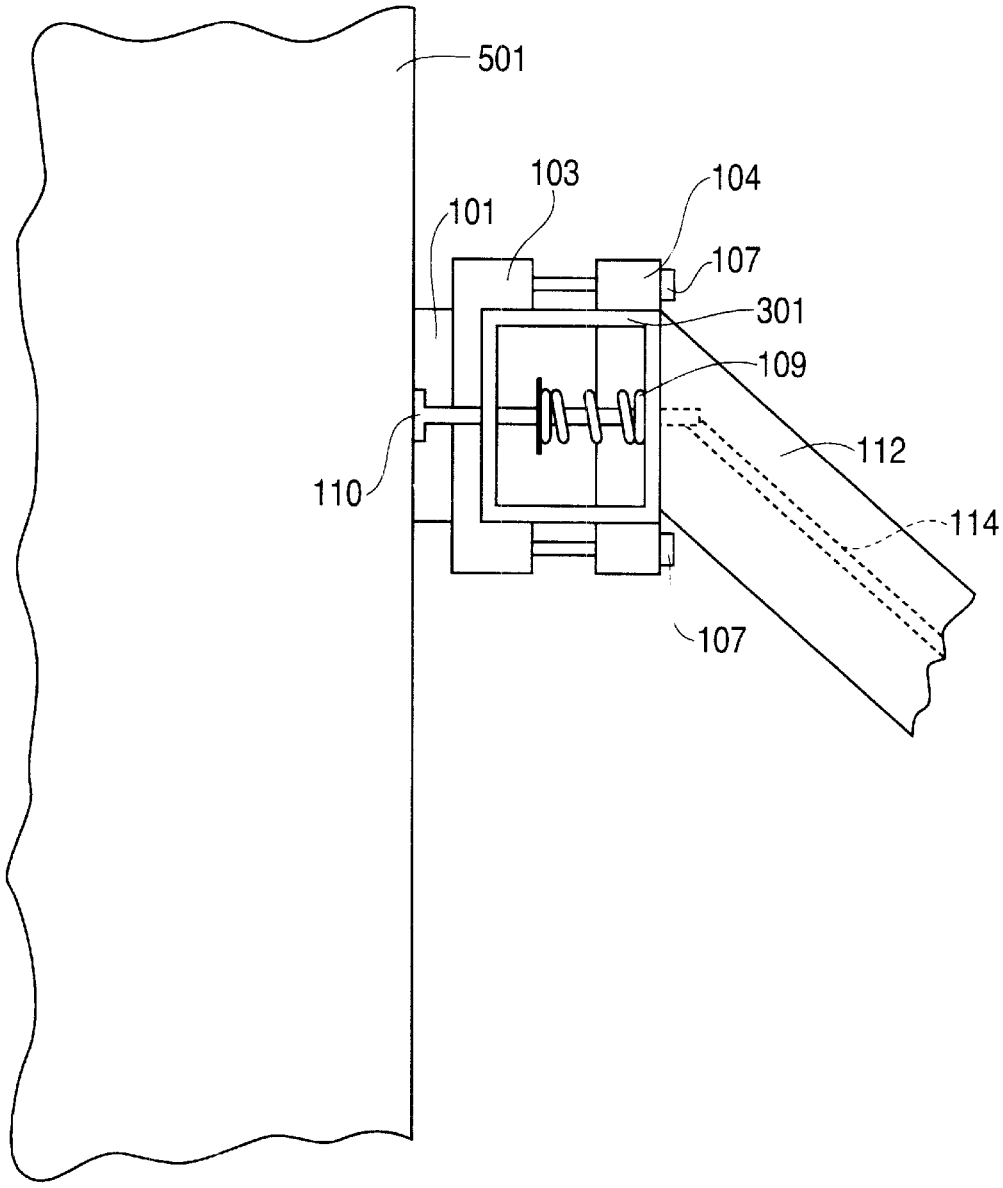
FIG. 6 is a view of the passive dynamically disconnecting arm when the object is in sustained movement.

FIG. 6 details the passive dynamically disconnecting arm attached to the object 501 as the object 501 in sustained movement. As the object 501 moves, the connector 101 pulls away from the shoulder housing 104 due to the floating platform created by the connection of the housing 103 and shoulder housing 104, as described above. As the connector 101 is pulled away from the shoulder housing 104, the spring 109, which is coupled to the plunger 110 begins to decompress ensuring that the plunger 109 is in substantial contact with the object 501.

After the object 501 moves a predetermined distance, preferably 4 mm to 6 mm, the connector 101 decouples to the object 501. After the object 501 moves a predetermined distance, preferably 9 mm to 11 mm, the spring 109 is substantially decompressed allowing the plunger 110 to move out of contact with the object 501. Since the spring 109 is substantially decompressed, the end of the plunger 110 releases the second end of the rod 114.

When the second end of the rod 114 is released, the first end of the rod 114 is not pressing into the divot 123 of the trunnion 115. This allows the compression spring 116 attached to the first end of arm 112 to overcome the frictional engagement of the first end of the rod 114 within the divot 123.

Compression spring 116 along with torsion spring 117 due to their connection to the arm 112 and post 118 overcome the frictional attachment of the first end of the rod 114 and the divot 123 and begin to decompress. The decompression of the compression spring 116 causes translation of arm 112 and the decompression of torsion spring 117 causes the arm to rotate around the axis within hole 201. This translation and rotation moves the arm 112 out of the path of the object 501 without rebounding off the object 501.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An apparatus for restraining and releasing a missile, comprising:

an elongated arm having a first end and a second end;

a trunnion attached to the first end of the arm having an elongated member;

a plunger attached to the second end of the arm; and means for connecting a rod to the trunnion and the plunger.

2. The apparatus, as claimed in claim 1, wherein a connector is attached to the second end of the arm.

3. The apparatus, as claimed in claim 2, wherein the connector has a floating platform.

4. The apparatus, as claimed in claim 2, wherein the connector is operatively coupled to an object and the plunger is substantially in contact with the object.

5. The apparatus, as claimed in claim 4, wherein the plunger is spring loaded.

6. The apparatus, as claimed in claim 5, wherein a torsion spring is operatively coupled to the first end of the arm causing the arm to rotate when the plunger is no longer in contact with the rod.

7. An apparatus, as claimed in claim 1, wherein a slot is formed within the first and second end of the arm.

8. An apparatus for restraining and releasing a missile, comprising:

an elongated arm having a first end and a second end wherein a slot is formed within the first and second end of the arm;

a trunnion attached to the first end of the arm having an elongated member;

the second end of the arm having a plunger, wherein the plunger has an elongated member; and within the slot of the arm is a rod wherein the first end of the rod is substantially in contact with the plunger and the second end of the rod is operatively coupled to the trunnion.

9. The apparatus, as claimed in claim 8, wherein a connector is attached to the second end of the arm.

10. The apparatus, as claimed in claim 9, wherein the connector has a floating platform.

11. The apparatus, as claimed in claim 9, wherein a torsion spring is operatively coupled to the first end of the arm causing the arm to rotate when the plunger is no longer in contact with the rod.

12. The apparatus, as claimed in claim 11, wherein the elongated member of the trunnion has at least one divot.

13. The apparatus, as claimed in claimed in claim 12, wherein the end of the rod is connected to the divot.

14. An apparatus for restraining and releasing a missile, comprising:

an elongated arm having a first end and a second end wherein a slot is formed within the first and second end of the arm;

a trunnion attached to the first end of the arm having an elongated member wherein on the elongated member is at least one divot;

a torsion spring attached to the first end of the arm and a fixed member;

a plunger attached to the second end of the arm, wherein the plunger has an elongated member within the second end of the arm;

a rod within the slot of the arm is a rod, wherein the first end of the rod is substantially in contact with the plunger and the second end of the rod is coupled to the at least one divot within the elongated member of the trunnion; and wherein the torsion spring causes the arm to rotate when the plunger is no longer in contact with the rod.

15. The apparatus, as claimed in claim 14, wherein a connector is attached to the second end of the arm.

16. The apparatus, as claimed in claim 15, wherein the connector has a floating platform.

17. The apparatus, as claimed in claim 15, wherein the connector is operatively coupled to an object and the plunger is substantially in contact with the object.

* * * * *